US006763775B1

(12) United States Patent
Sweeting

(10) Patent No.: US 6,763,775 B1
(45) Date of Patent: Jul. 20, 2004

(54) MARINE BILGE PUMP MOUNTING SYSTEM

(76) Inventor: B. Stephen Sweeting, #12 Brooklyn Rd, No. 2, Nassau (BS)

( * ) Notice: Subject to any disclaimer, the term of this patent is extended or adjusted under 35 U.S.C. 154(b) by 0 days.

(21) Appl. No.: 10/446,323

(22) Filed: May 28, 2003

(51) Int. Cl.[7] ..... B63B 13/00
(52) U.S. Cl. ..... 114/184
(58) Field of Search ..... 114/183 R, 184, 114/185

(56) References Cited

U.S. PATENT DOCUMENTS 4,913,075 A * 4/1990 Rohr, Jr. ..... 114/185
5,211,363 A 5/1993 Brown
5,632,220 A * 5/1997 Vento ..... 114/255
6,056,881 A * 5/2000 Miller et al. ..... 210/702
D439,136 S 3/2001 Rogers
6,322,030 B1 11/2001 Marra

* cited by examiner

*Primary Examiner*—Jesus D. Sotelo
(74) *Attorney, Agent, or Firm*—Charles J. Prescott

(57) ABSTRACT

A universal marine bilge pump mounting system releasably securable either between spaced parallel stringers or between an inner surface of the hull and a higher support surface spaced above the bilge. A base plate is adapted in size to supportively receive the bilge pump and float switch. An upright support member is connected to, and upwardly extends from, the base plate. A bilge surface engaging member of adjustable overall length includes a contact member connected at a distal end thereof. A proximal end of the bilge surface engaging member is releasably connectable in a first use mode to the upright support member. Two bilge surface engaging members are releasably connectable in a second use mode to, and extending in either direction from, the upper end of the upright support members whereby the base plate is supportable above or against the hull inner surface.

3 Claims, 4 Drawing Sheets

FIG 4
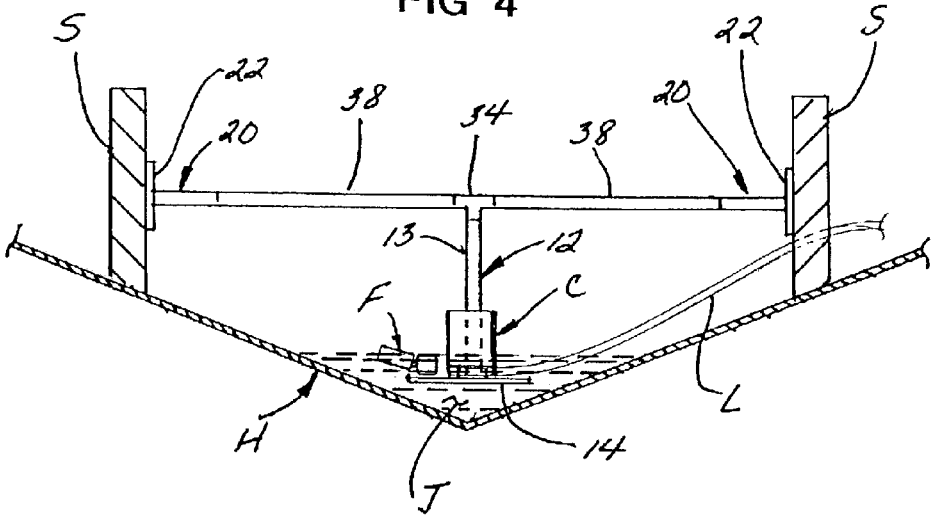
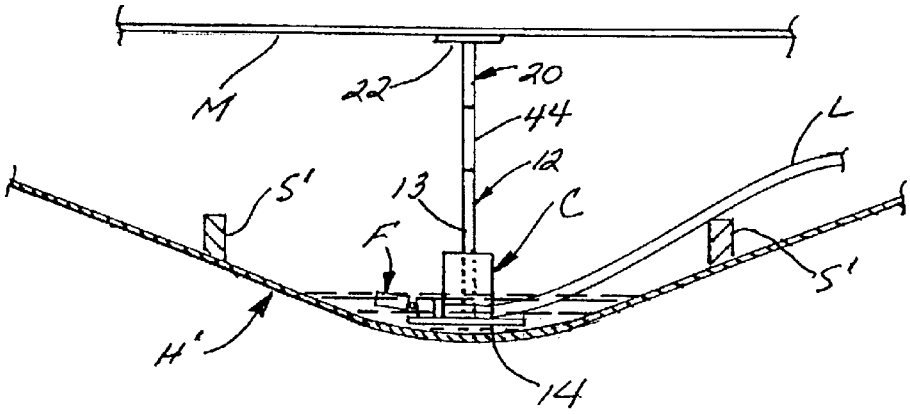
FIG 5

MARINE BILGE PUMP MOUNTING SYSTEM

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to the boating industry, and more particularly to support arrangements for bilge pumps and accessory float switches used to operate such bilge pumps.

2. Description of Related Art

Most recreational and smaller commercial boats and vessels have one or more bilge pumps utilized to evacuate excess water accumulating in the bilge. Such bilge pumps are placed directly into the bottom of the bilge and are typically operated by a float switch which responds to rising bilge water to cause the bilge pump to be operably connected to a power source to effect bilge water evacuation.

The mounting of both the bilge pump and the float switch necessarily in sufficiently close proximity to the inner hull surface defining the lower bilge area into which water accumulates is somewhat problematic. One common way of securing the bilge pump and the float switch is by mechanical fastening means attached into the inner hull surface which may cause even the toughest of sailors and boaters to shudder with concern over the long-term effects of fastener penetration of the hull. Additionally, the obnoxious content of bilge water can have a detrimental effect on the best of fasteners to cause accelerated corrosion and rust thereof.

A marine bilge pump mount is disclosed in U.S. Pat. No. 6,322,030 invented by Marra which teaches a marine bilge pump mount, an upper section thereof being attachable to suitable elevated bilge structure within a boat which supports a center section which is pivotally connected to the upper section and a lower support pad atop which a bilge pump and float switch may be mounted. Although the center section is adjustable in height to properly position the elevation of the bilge pump and float switch for proper evacuation of bilge water, the versatility of this arrangement is somewhat limited.

Brown has invented a bilge pump bracket as disclosed in U.S. Pat. No. 5,211,363 which also teaches a device connectable to an upright support panel in a bilge. This arrangement is formed as a unit and is very limited in its installation versatility and accommodation to a wide variety of bilge structural components associated therewith.

In U.S. Pat. No. D439,136, Rogers discloses the ornamental aspects of another unique bilge mounting bracket which apparently is utilized for releasable engagement with the body of the bilge pump itself.

The present invention teaches a universal system for mounting and easy servicing of a marine bilge pump and associated float activation switch in close proximity to the bottom of the bilge or bilge area where bilge water accumulates within the hull of a boat.

The device includes a support plate and elongated upright support member, the base plate adapted in size to supportively receive a bilge pump, its associated attaching lower molded bracket and a float switch used to activate the bilge pump itself responsive to bilge water accumulation levels. A bilge surface engaging member of adjustable overall length, in combination with various extension and T-connection members facilitate receiving support within the bilge from either a generally horizontal support structure spaced above the bilge or spaced apart hull stringers which present spaced upright support surfaces against which the bilge surface engaging members are adjustably tightened to effect support securement of the upright support member and base plate itself atop which the bilge pump and float switch are mounted. No special tools, fasteners or adhesives are required to effect installation.

BRIEF SUMMARY OF THE INVENTION

This invention is directed to a universal marine bilge pump mounting system releasably securable either between spaced parallel stringers or between an inner surface of the hull and a higher support surface spaced above the bilge. A base plate is adapted in size to supportively receive the bilge pump and float switch. An upright support member is connected to, and upwardly extends from, the base plate. A bilge surface engaging member of adjustable overall length includes a contact member connected at a distal end thereof. A proximal end of the bilge surface engaging member is releasably connectable in a first use mode to the upright support member. Two bilge surface engaging members are releasably connectable in a second use mode to, and extending in either direction from, the upper end of the upright support members whereby the base plate is supportable above or against the hull inner surface.

It is therefore an object of this invention to provide a universal marine bilge pump mounting system which facilitates the supportive attachment and easy servicing of a bilge pump-and associated float switch activating means in proper position in close proximity to the lower hull interior surface and bilge water which accumulates therewithin.

Still another object of this invention is to provide a universal system for mounting a bilge pump by utilizing either existing spaced apart stringers associated with the hull construction or overhead support surfaces or beam structure within the bilge as desired.

In accordance with these and other objects which will become apparent hereinafter, the instant invention will now be described with reference to the accompanying drawings.

BRIEF DESCRIPTION OF THE SEVERAL VIEWS OF THE DRAWING(S)

FIG. 4 is a cross section view of the vessel stringers and boat hull and the first use mode of support shown in FIG. 3.

FIG. 5 is a section view showing a second mode of use of the system of the invention supporting a bilge pump and float switch in close proximity to bilge water accumulation at the bottom of the hull inner surfaces.

DETAILED DESCRIPTION OF THE INVENTION

Figure 1:
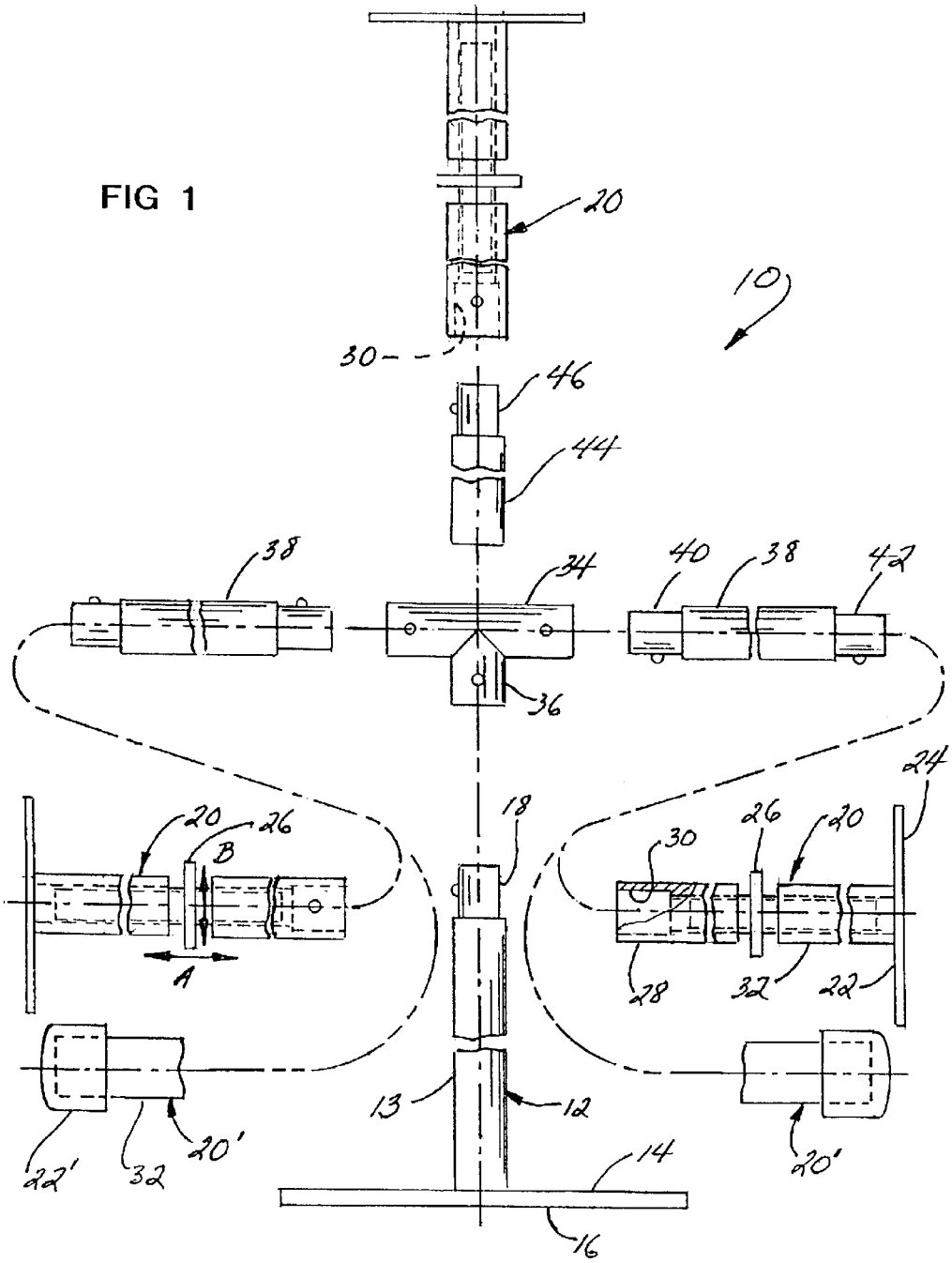
FIG. 1 is an exploded view of the entire universal marine bilge pump mounting system.

Referring now to the drawings, and firstly to FIG. 1, the universal marine bilge pump mounting system is there shown generally at numeral 10. This system 10 includes a bilge pump support 12 having a generally flat base plate 14 and bottom surface 16 and an elongated upright support member 13 rigidly attached in orthogonal relationship to and along one margin of the base plate 14. A reduced-in-size upper distal end 18 is configured for releasable connection to either one leg 36 of a T-fitting 34 in one mode of use or to one end 44 of a tubular extension 44.

Figure 2:
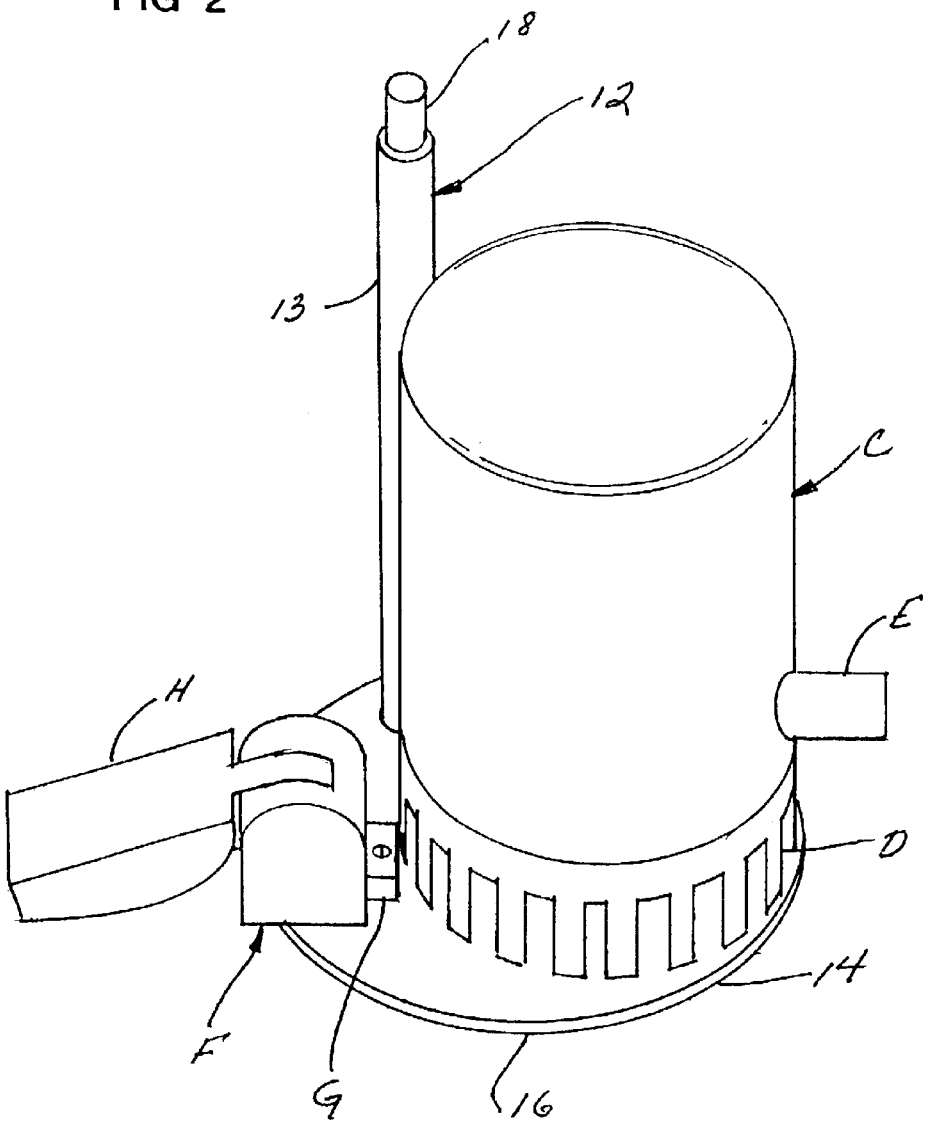
FIG. 2 is a perspective view of the lower flat base plate and upright support member showing a conventional bilge pump and float switch supportively attached atop the base plate.

Referring also to FIG. 2, the bilge pump C and its lower molded attaching base D are shown connected to the base plate 14 immediately adjacent to or releasably attached to the float switch F. The float switch F is typically attached to the base plate 14 by its attaching lug G. When in operation, the bilge pump C draws water through the slots in the molded support base D for discharge through outlet E which is attachable to a separate flexible conduit for discharge overboard as shown in FIGS. 4 and 5 described herebelow.

Figure 3:
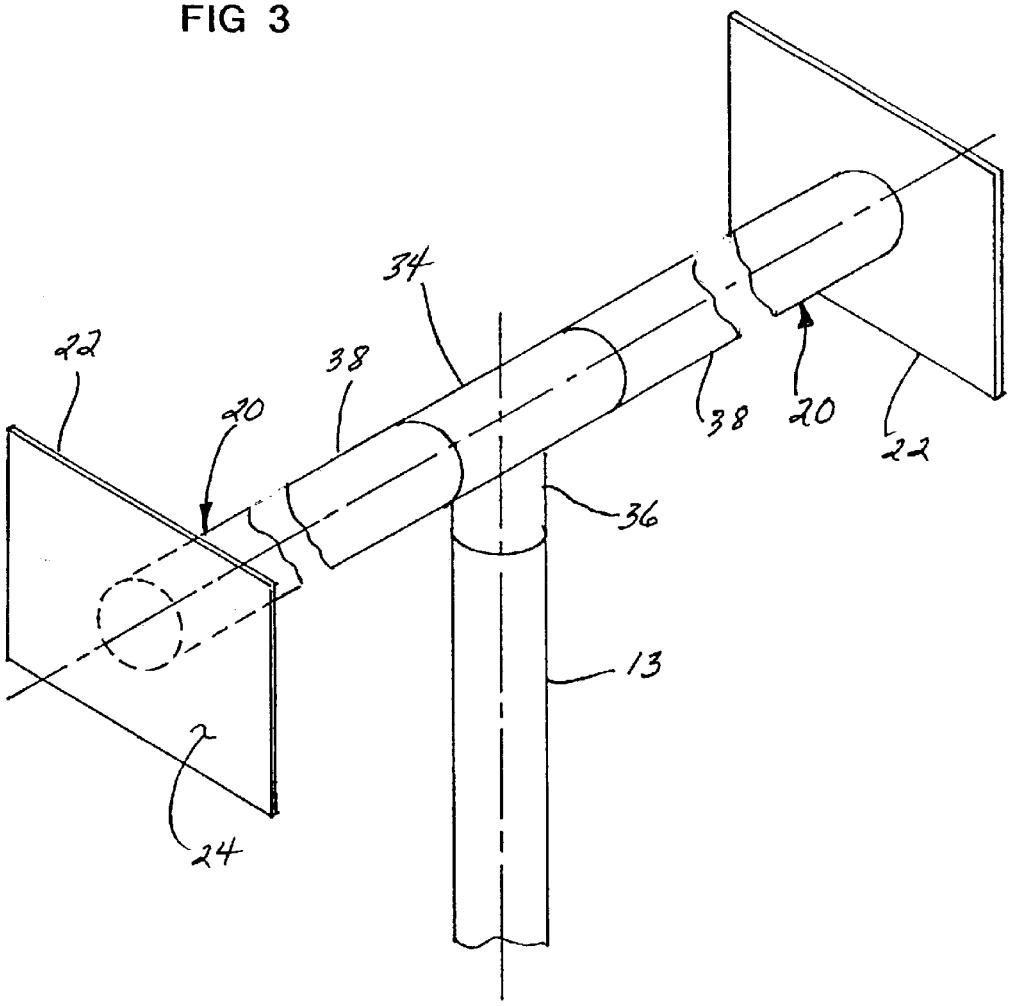
FIG. 3 is a perspective view of a first use mode of system releasably attached against spaced apart stringers of the hull of a boat or vessel.

Referring additionally to FIGS. 3 and 4, one mode of using the present invention is there depicted. The T-connector 34 is releasably attached to the upper distal end 18 of the upright support member 13. Lateral extensions 38 are releasably connected at one end 40 to the other two legs of the T-connector 34 and, at the opposite end 42 thereof into mating female end 30 of an elongated bilge surface engaging member 20 by conventional spring biased detent means. In both use modes described herebelow, at least one bilge surface engaging member 20 is utilized. This bilge surface engaging member 20 is generally adjustable in length by providing two oppositely internally threaded tubular members 28 and 32 held in spaced apart relationship one to another by, and forming a turnbuckle-type arrangement with, adjusting member 26. This adjusting member 26 has right-hand threads disposed on one end thereof and left-hand threads matably engaged by the other end thereof and are threadably engaged into the opposite internally threaded member 28 and 32, respectively. By this arrangement, the overall length of the bilge surface engaging member 20 is effected by rotation of an enlarged central portion 26 between the threaded halves in the direction of arrow B to effect elongation or contraction in the direction of arrow A of the entire bilge surface engaging member 20.

A contact plate or pad 22 is rigidly connected in orthogonal relationship to the axis of the coaxially aligned tubular members 28 and 32. The pad or plate 22 has a bilge surface engaging surface 24 which may be textured or frictionally coated for enhanced resistive attachment against the inner opposing surfaces of spaced apart stringers S shown in FIG. 4. By suitably extending the overall length of each of the bilge surface engaging members 20 in the use mode shown in FIG. 4, frictional engagement against the inner surfaces of the stringers S is achieved after proper vertical height adjustment of the bilge pump C attached to the base plate 14 as previously described. An elongated flexible conduit L sealingly attached to the output tube E effects overboard discharge of bilge water J when the bilge pump C is activated.

Note in this use embodiment in FIG. 4, that the base plate 14 need not be placed against and receive support from the interior surface of the hull H if it is desired to keep the bilge pump C and float F somewhat above the lower level of the bilge pump water J which accumulates at the bottom of the hull H. The exact configuration of the hull H will be a factor in determining the bilge water level remaining once the bilge pump C has fully evacuated bilge water down to the preselected liquid level at which the float switch F deactivates the bilge pump C.

Referring now to the FIG. 5, the second or alternate use mode is there shown wherein the bilge area of the boat includes a generally horizontal structure M in the form of a crossbeam or interior sole or deck structure which is spaced above the lower accumulating area of the hull H'. Note in this embodiment that the stringers S' are either spaced too widely apart or are not of sufficient height or having parallel opposing facing surfaces to allow the first mode of use described hereinabove with respect to FIGS. 3 and 4.

With the bilge pump C attached atop the base plate 14' with the float switch F positioned adjacent thereto as previously described atop the base plate 14, the upright support member 13 is shown releasably engaged with coaxial extension member 44 which, in turn, is connected at opposite end 46 into cavity 30 of the bilge surface engaging member 20. With the contact pad or plate 22 adjustably positioned by suitable rotation of adjusting member 26, the plate 22 will press against the bilge structure M positioned above the lower portion of the hull H' so as to cause the base plate 14 to downwardly press against and receive support from the inner surface of hull H'. This arrangement places the base plate 14 in closer proximity to the very bottom portion of bilge water accumulating for bilge pump removal. Again, a flexible conduit L attached to the outlet tube E of the bilge pump C effects overboard discharge of bilge water from the boat.

Referring again to FIG. 1, an alternate embodiment of the distal contact member is also shown at numeral 22'. This end cap 22' may be formed of soft plastic or elastomer material and provides a smaller contact area against the above-described bilge structure to effect either first or second mode of use of the system.

Again, by suitable use of various lengths of extension members and the adjustable length feature of the bilge surface-engaging member 20', installation in terms of either the first or second use modes is effected without the need for tools, fasteners or other attaching means to fully and properly support the bilge pump and its associated float switch in a manner which facilitates the easy removal of the bilge pump and float switch for servicing and cleaning when necessary.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A universal marine bilge pump mounting system releasably securable between spaced parallel stringers or beams and between an inner surface of the hull and a support surface spaced above a bilge of a boat comprising:

a flat base plate adapted in size to receive and support a bilge pump and float switch positioned or attached thereatop;

an elongated upright support member connected at a lower end thereof to, and upwardly extending from, an edge portion of said base plate;

a T-connector a central leg of which is releasably connectable to an upper end of said upright support member;

an elongated lateral extension member releasably connectable to each opposing laterally extending leg of said T-connector;

an elongated bilge surface engaging member of adjustable overall length having a contact pad or plate connected to a distal end thereof, a proximal end of said bilge surface engaging member being releasably connectable in a first use mode of said system to the upper end of, and upwardly extending coaxially from, said upright support member whereby said base plate carrying the bilge pump and float switch is securable against the inner hull surface by adjusting the length of said bilge surface engaging member to forcibly urge said contact pad or plate against the overhead support surface;

one said bilge surface engaging member releasably connectable in a second use mode of said system to a distal end of each of said lateral extension members whereby said base plate carrying the bilge pump and float switch is supportable above or against the hull inner surface by adjusting the length of each said bilge surface engaging member to forcibly urge each said contact pad or plate in outwardly opposing fashion against the stringers or beams.

2. A universal marine bilge pump mounting system releasably securable in a first use mode between spaced upright parallel stringers or beams or, in a second use mode, between an inner surface of the hull and a support surface spaced above a bilge of a boat comprising:

a flat generally horizontal base plate adapted in size to receive and support a bilge pump and float switch positioned or attached thereatop;

an elongated upright support member rigidly connected at a lower end thereof to, and upwardly extending from, an edge portion of said base plate;

an elongated bilge surface engaging member of adjustable overall length having a contact member connected to a distal end thereof, a proximal end of said bilge surface engaging member being releasably connectable in the first use mode to the upper end of, and upwardly extending generally coaxially from, said upright support member whereby said base plate carrying the bilge pump and float switch is securable against the inner hull surface by adjusting the length of said bilge surface engaging member to forcibly urge said contact pad or plate against the overhead support surface;

two of said bilge surface engaging members releasably connectable in the second use mode to, and laterally extending in either direction from, said upright support member whereby said base plate carrying the bilge pump and float switch is supportable above or against the hull inner surface by adjusting the length of each of said bilge surface engaging members to forcibly urge each said contact member in outwardly opposing fashion against the stringers or beams.

3. A universal marine bilge pump mounting system releasably securable in a first use mode between spaced parallel stringers or beams and, in a second use mode, between an inner surface of the hull and a support surface spaced above a bilge of a boat comprising:

a flat base plate adapted in size such that, when positioned substantially horizontally, receives and supports a bilge pump and float switch positioned or attached thereatop;

an elongated upright support member connected at a lower end thereof to, upwardly extending from, and in dose proximity to, an edge portion of said base plate;

an elongated bilge surface engaging member of adjustable overall length having a contact member connected to a distal end thereof, a proximal end of said bilge surface engaging member being releasably connectable in the first use mode to the upper end of, and upwardly extending coaxially from, said upright support member whereby said base plate carrying the bilge pump and float switch is securable against the inner hull surface by adjusting the length of said bilge surface engaging member to forcibly urge said contact pad or plate against the overhead support surface;

a pair of said bilge surface engaging members each being releasably connectable in the second use mode to a distal end of intermediate lateral extension members releasably attached to said upright support member whereby said base plate carrying the bilge pump and float switch is supportable above or against the hull inner surface by adjusting the length of each said bilge surface engaging member to forcibly urge each said contact member in outwardly opposing fashion against the stringers or beams.

* * * * *